US006543363B2

(12) United States Patent
Brion

(10) Patent No.: US 6,543,363 B2
(45) Date of Patent: Apr. 8, 2003

(54) PRIMER TUBE FOR ARTILLERY AMMUNITION

(75) Inventor: Bernard Brion, Bourges (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 09/857,709

(22) PCT Filed: Mar. 20, 2001

(86) PCT No.: PCT/FR01/00822

§ 371 (c)(1),
(2), (4) Date: Jun. 8, 2001

(87) PCT Pub. No.: WO01/71274

PCT Pub. Date: Sep. 27, 2001

(65) Prior Publication Data

US 2002/0124760 A1 Sep. 12, 2002

(30) Foreign Application Priority Data

Mar. 23, 2000 (FR) ..... 00 03821

(51) Int. Cl.[7] ..... F42B 5/02; F42B 5/18; F42B 5/285

(52) U.S. Cl. ..... 102/470; 102/431; 102/467

(58) Field of Search ..... 102/202, 430–433, 102/466, 467, 469, 470, 100

(56) References Cited

U.S. PATENT DOCUMENTS

| | | | | | |
|---|---|---|---|---|---|
| 3,288,066 | A | * | 11/1966 | Stadler et al. | 102/470 |
| 4,197,801 | A | * | 4/1980 | LaFever et al. | 102/433 |
| 4,674,405 | A | * | 6/1987 | Brede et al. | 102/202 |
| 4,763,577 | A | * | 8/1988 | Romer et al. | 102/431 |
| 4,913,052 | A | * | 4/1990 | Hoerr et al. | 102/202 |
| 5,155,295 | A | * | 10/1992 | Campoli | 102/431 |
| 5,277,118 | A | * | 1/1994 | Conil | 102/431 |
| 5,335,600 | A | * | 8/1994 | Horr et al. | 102/470 |

FOREIGN PATENT DOCUMENTS

| | | | | |
|---|---|---|---|---|
| DE | 4223735 | * | 1/1994 | 102/470 |
| EP | 0 100 840 | | 2/1984 | |
| EP | 44 11 167 | | 10/1994 | |
| FR | 2343987 | * | 10/1977 | 102/470 |
| FR | 2517046 | * | 5/1983 | 102/470 |

* cited by examiner

*Primary Examiner*—Harold J. Tudor
(74) *Attorney, Agent, or Firm*—Parkhurst & Wendel, L.L.P.

(57) ABSTRACT

The invention relates to a primer tube (1), notably for the propellant charge (4) of artillery ammunition (2).

Figure 1:
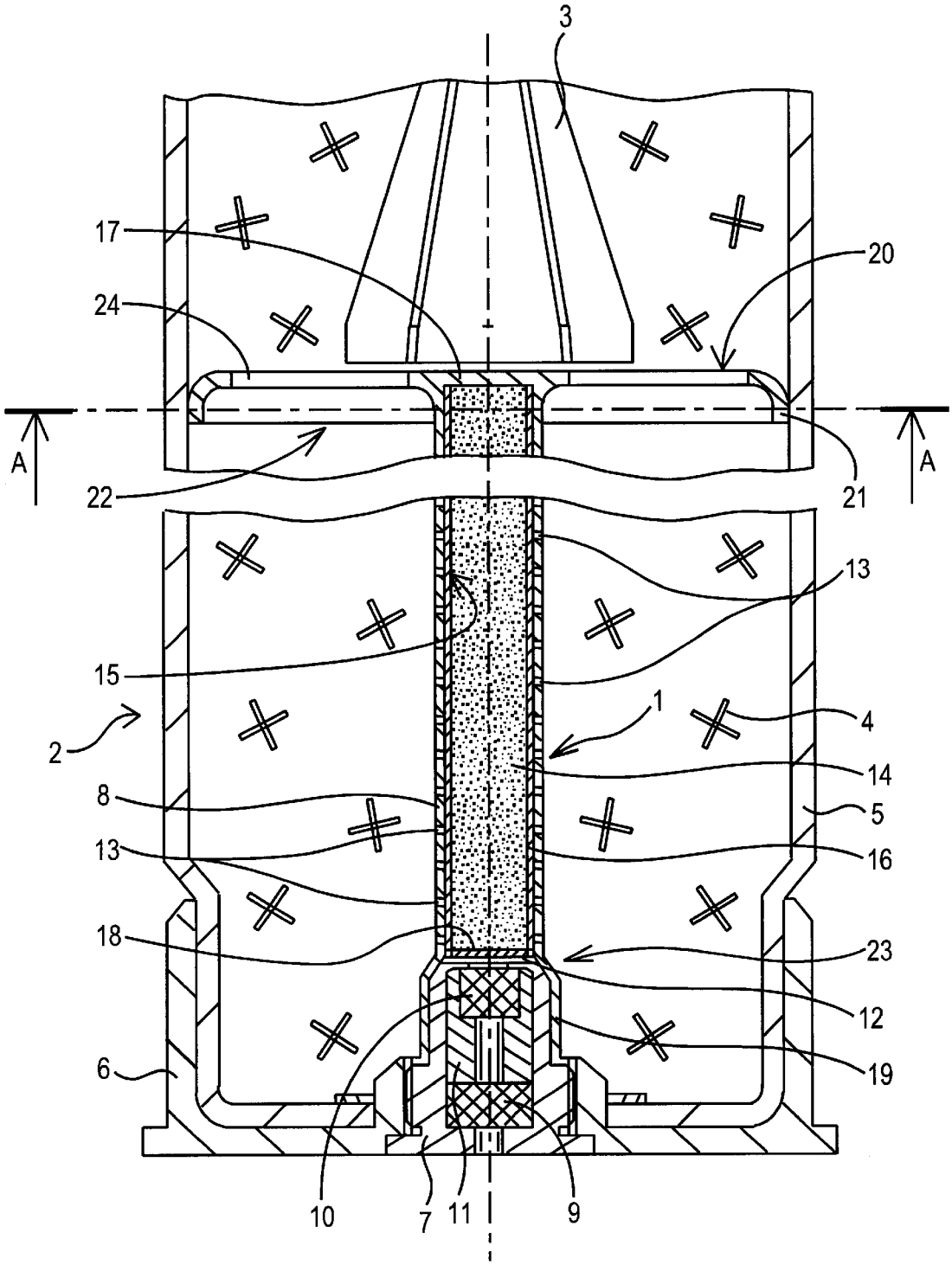

The primer tube (1) is formed of a tubular body (8) accommodating a priming composition (14). It is characterized in that the tubular body (8) incorporates at least one receiving surface (25) oriented so as to receive the propellant gas pressure generated when the propellant charge (4) is ignited, said gas acting to propel the primer tube (1).

The pressure receiving surface (25) is a disk (20) arranged substantially radially to the tubular body (8).

14 Claims, 5 Drawing Sheets

PRIMER TUBE FOR ARTILLERY AMMUNITION

The technical scope of the present invention is that of primer tubes, in particular for artillery ammunition.

Primer tubes are intended to ensure the ignition of the propellant charge of a piece of ammunition.

Known primer tubes are generally formed of a rear ignition unit intended to prime a priming composition arranged inside a tubular body integral with the rear unit.

Primer tubes are generally made integral with the ammunition by screwing the rear unit to the ammunition stub base.

Today, the ammunition being used is more and more frequently formed of a combustible case and a generally metallic obstructing base.

Thus, after the ammunition has been fired, the only non-combustible part that is ejected from the weapon, and then temporarily stored inside the turret, is the obstructing base that takes up relatively little space.

Known primer tubes that are formed by a metallic tubular body present the main disadvantage of protruding from the obstructing base. This complicates the ejection of the base from the weapon chamber and its subsequent storage in the turret after firing. Such a primer tube is described in patent FR2343987.

To overcome this disadvantage, patent FR2593905 proposes replacing the metallic tubular body by a heat-shrinkable sheath that ensures the priming tablets are held in place and are integral with the rear unit.

The advantage of such a solution lies in that it ensures the full combustion of the combustible tubular body. The only incombustible part is the rear unit, which is of a height lower than that of the obstructing base. Thus, the ejection and storage of the base are not disturbed.

However, this primer tube has other disadvantages. In fact, the heat-shrinkable sheath acting as the tubular body has a certain flexibility that generates an embattlement, which may lead to its fracture due to vibrations and other mechanical stresses to which the ammunition is subjected during the different transportation and loading phases.

Patent EP0100840 describes a primer tube that incorporates a combustible tubular body that separates from the metallic rear unit. Thus, if the tubular body is not fully consumed, it does not remain attached to the rear unit but is ejected from the barrel. To do this, a separation charge is installed in a cavity made in the rear unit in contact with the tubular body. The main disadvantage of such a solution lies in its complexity, which leads to difficulties in its manufacture and implementation, thereby raising the cost.

The aim of the present invention is to propose a primer tube that overcomes such disadvantages.

Thus, the primer tube according to the invention does not remain attached to the obstructing base after firing and said base can be ejected and stored optimally.

The primer tube according to the invention is of a simple design and reasonable cost.

The invention thus relates to a primer tube, notably for the propellant charge of artillery ammunition, formed of a tubular body accommodating a priming composition, said primer tube characterized in that the tubular body incorporates at least one receiving surface oriented so as to receive the propellant gas pressure generated when the propellant charge is ignited, said gas acting to propel the primer tube.

Advantageously, the pressure receiving surface can be a disk arranged substantially radial to the tubular body.

The disk can be arranged at the upper end of the tubular body.

The disk can incorporate a cylindrical seat of a diameter substantially equal to the internal diameter of a combustible ammunition case.

Advantageously, the disk can incorporate openings allowing the ammunition to be loaded with propellant.

Preferentially, the tubular body can be extended at its lower end by a tubular sleeve.

The tubular sleeve can envelope a rear ignition unit integral with a munition base or an intermediate part integral with the case and a rear ignition unit.

Advantageously, the priming composition will be placed in an internal channel of the tubular body, said channel delimited at its upper end by a wall integral with the disk and at its lower end by a foil.

The priming composition can be pulverulent or formed by a stack of tablets and incorporate an axial channel.

The priming composition can comprise at least two energetic primacords.

The tubular body can has a flared part at its upper end intended to make it easier for the primacords to exit.

A first advantage of the device according to the invention lies in that the tubular body of the primer tube is ejected from the weapon barrel.

A further advantage lies in that after firing the obstructing base of the munition has no protruding elements. It thus takes up little space and can therefore be ejected from the weapon chamber, then optimally stored in the turret.

Another advantage lies in that the combustible case of the munition is stiffened around the disk, thereby improving its mechanical strength.

Figure 2:
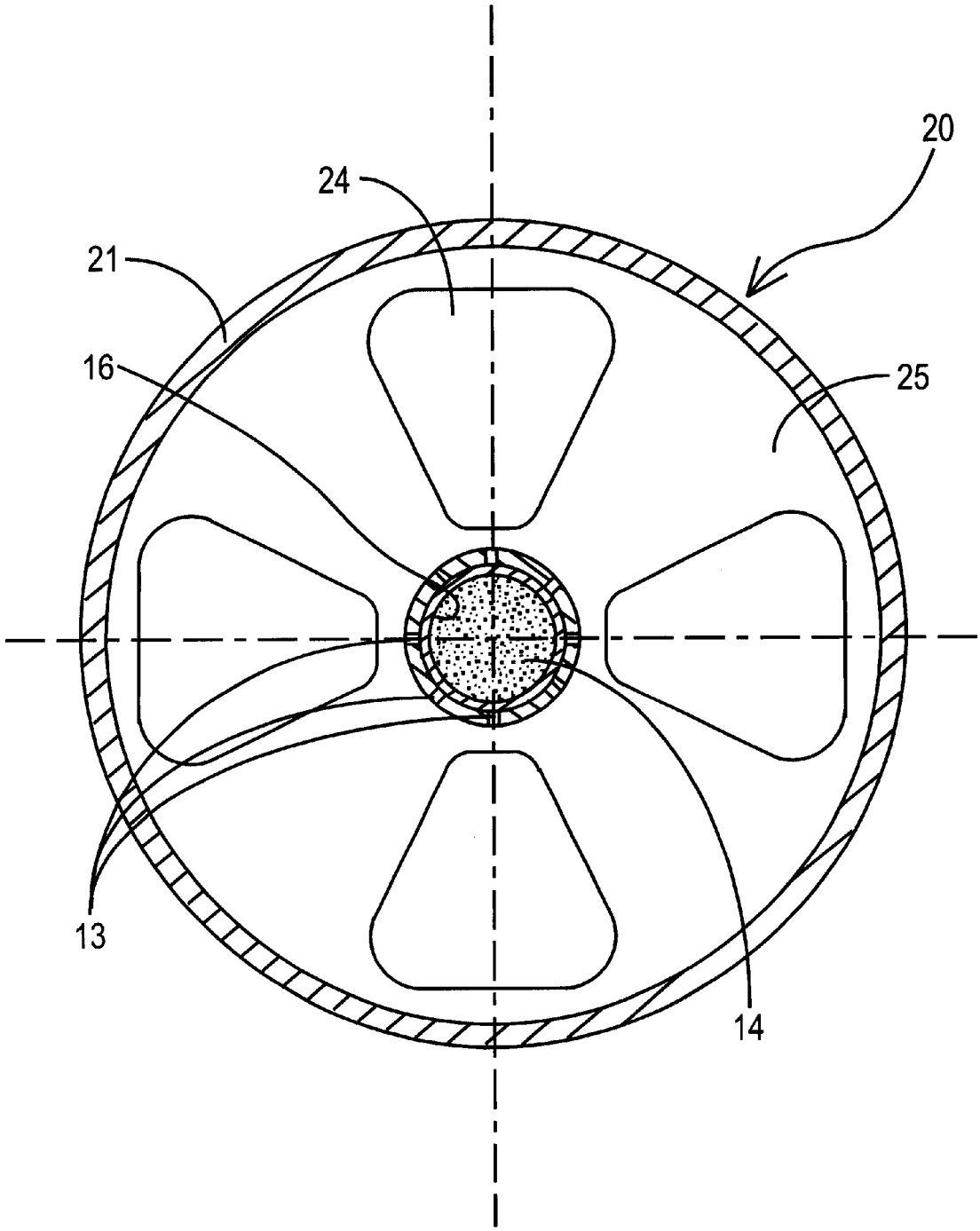
Figure 3:
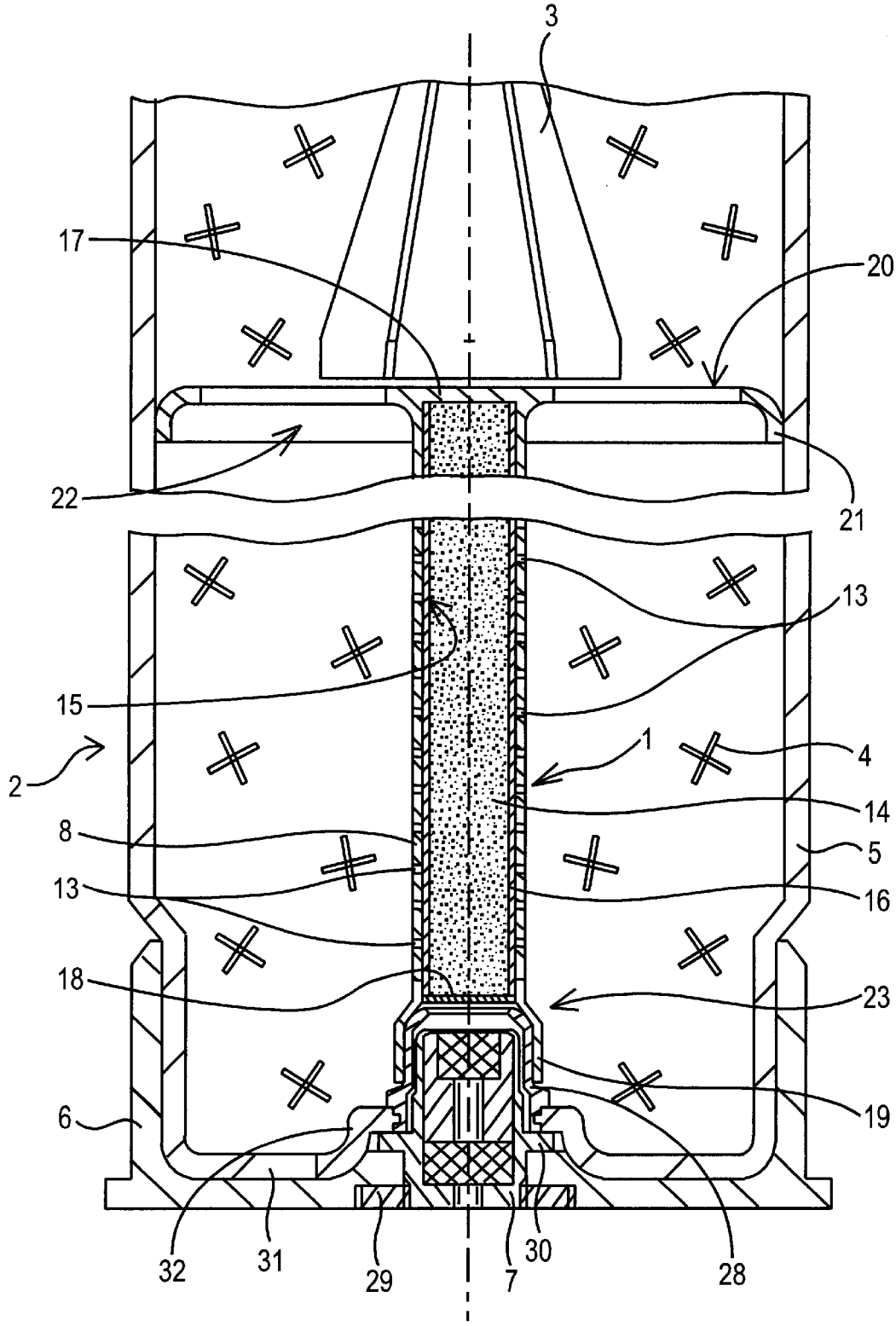
Figure 4:
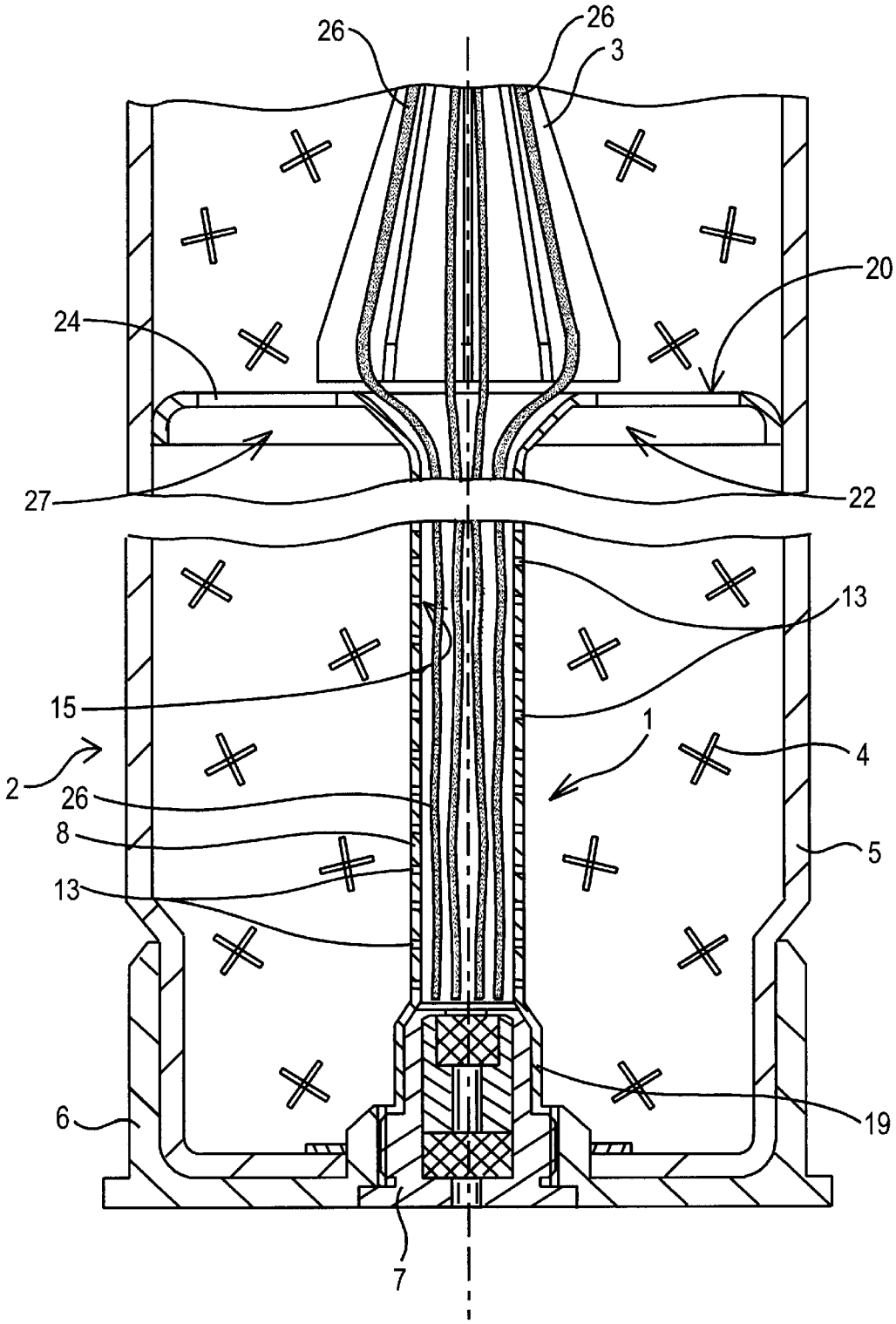
Figure 5:
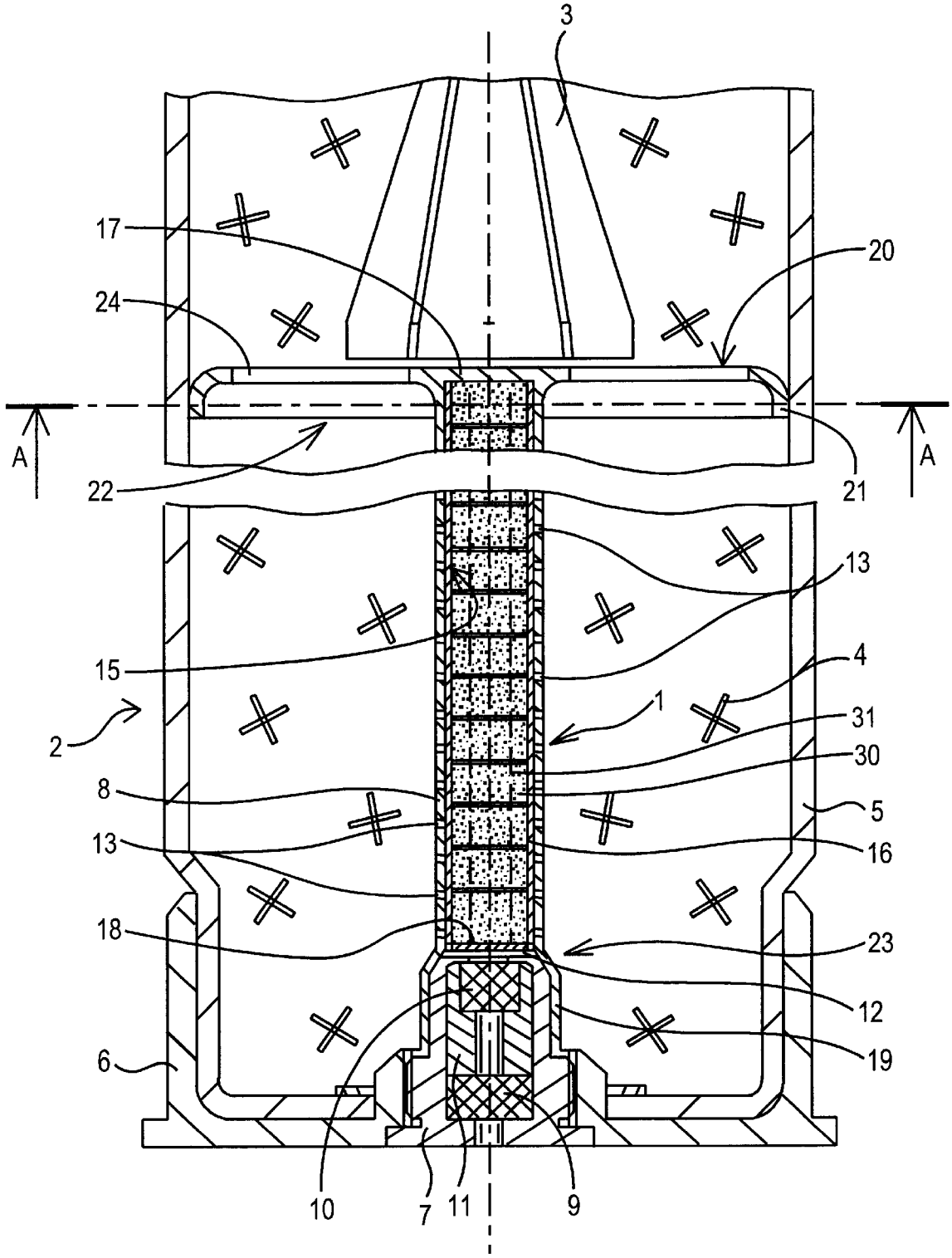

Other characteristics, details and advantages of the invention will become more apparent from the description given hereafter by way of illustration and in reference to the appended drawings, in which:

FIG. 1 is a partial longitudinal section view of a munition fitted with a primer tube according to a first embodiment of the invention, FIG. 2 is a section view of the primer tube according to the section plane AA shown in FIG. 1, FIG. 3 is a partial longitudinal section view of a munition according to a variant embodiment, FIG. 4 is a partial longitudinal section view of a munition fitted with a primer tube according to a second embodiment of the invention, FIG. 5 is a partial longitudinal section view of the invention fitted with a priming tube including a priming composition formed by a stack of tablets.

In FIG. 1, a primer tube 1 according to the invention is mounted into an artillery ammunition 2 incorporating a projectile 3, that here is of the fin-stabilized discarding-sabot type and of which only the tail section can be seen. The projectile 3 is associated with a propellant charge 4 contained inside a combustible case 5. A metallic obstructing base 6 closes the case 5.

The primer tube 1 is formed, conventionally, of a rear ignition unit 7 screwed to the obstructing base 6 and a tubular body 8.

The rear unit 7 classically incorporates priming means formed, for example, by an electric or percussion squib 9 connected to a flame-intensifying pyrotechnic relay 10. The squib 9 and the relay 10 are separated by a spacer 11 and are made integral with the rear unit 7 by annular crimping 12.

The tubular body 8 incorporates lateral vents 13 evenly spaced angularly and axially, which are intended to allow the passage of the combustion gases generated by a priming composition 14, for example pulverulent black powder, placed in an internal channel 15 in the tubular body.

The channel 15 is delimited by an internal sheath 16, made for example of tin, that contains the priming composition and protects it from the effects of any humidity until its combustion. The sheath 16 thus ensures the temporary obstruction of the lateral vents, 13.

At its upper end, the tubular body 8 incorporates a wall 17 that obstructs the internal channel 15. This wall could be replaced by a plug made integral with the body, for example by bonding, clipping or screwing.

The internal channel 15 can thus receive the priming composition 14 and then be closed off by a foil 18, preferably made of a combustible material.

The tubular body 8 is extended at its lower end 23 by a sleeve 19, which is tubular and of a greater diameter than the body, covering the rear ignition unit 7. The sleeve 19 is slipped over the rear unit 7 such that it is able to slide freely on the unit.

The sleeve 19 can also be temporarily linked to the rear unit 7, for example by clipping. Thus, the sleeve can have pins that engage in a groove made around the periphery of the rear unit.

The tubular body 8 is also extended at its upper end 22 by a disk 20 placed radially.

The disk 20 incorporates a cylindrical seat 21 of a diameter substantially equal to the internal diameter of the combustible case 5.

The cylindrical seat 21 centres the primer tube 1 perfectly inside the case 5 and eases its guidance. It also allows the bearing surface of the disk on the combustible case to be increased, thereby limiting the mechanical stresses at the point of contact.

The cylindrical seat 21 thus reinforces the rigidity of the case to the rear of the projectile 3. It thereby attenuates the risks of embrittlement or even fracturing of the case during the different transportation and loading operations of the ammunition.

Advantageously, and as seen in this figure, the tubular body 8, the sleeve 19 and the disk 20 are made as a single part, but they can equally well be composed of several different parts that would be joined together.

The tubular body 8, sleeve 19 and disk 20 assembly is preferentially made of an inert material compatible with the propellant charge. Advantageously, it is made of a polymer. such as, for example, a high-density polyethylene, and can be obtained by molding, extrusion or blow molding. This assembly can naturally also be made of a semi-combustible or combustible material.

The priming composition 14 can incorporate an axial channel so as to improve the propagation of its combustion. This channel can be delimited by a tube, for example of a combustible material, positioned in the middle of the composition.

The priming composition 14 can also be made in the form of a stack of ring-shaped tablets 30, including axial channel 31 therein, as shown in FIG. 5.

The lateral vents 13 can be replaced by blind holes having incipient fractures that are broken during the build-up of pressure of the gases generated by the priming composition 14.

With reference to FIG. 2, the disk 20 incorporates openings 24, for example four of them evenly spaced angularly. They allow the bottom part of the case located between the obstructing base 6 and the disk 20 to be filled with propellant powder 4.

The openings 24 are of a size and shape such that the surface 25 remaining to receive the propellant gas pressure is enough to ensure the displacement of the primer tube in the case, as will be explained later in the description.

The disk 20 can thus be made in the shape of a star having at least three branches, so long as the pressure-receiving surfaces are large enough. In this case, a cylindrical seat 21 shall be provided at the end of each branch to ensure the guidance of the disk inside the case.

A primer tube according to the invention is mounted as follows:

- the case 5 is positioned inside the obstructing base 6,
- the case and base are joined in a conventional manner, such as that described in patent FR2365096,
- the rear unit 7 is screwed into the obstructing base,
- the tubular body 8 fitted with its disk 20 is placed inside the case 5 (the tubular body having naturally already been filled with priming composition 14),
- the sleeve 19 of the tubular body is fitted over the rear unit 7,
- the lower part of the case located between the obstructing base and the disk is filled with propellant powder via the openings 24 in the disk 20,
- then the projectile and the upper propellant charge can be introduced inside the case in a conventional manner, for example by means of a casing joining the projectile and its load. Such a loading case is described in patent FR2622687.

Such a primer tube operates as follows:

When the ammunition is fired, the squib 9 then the relay 10 are ignited and inflame the priming composition 14. The pressure generated by the combustion of the priming composition instantly destroys the internal sheath 16 and ignites the propellant charge 4 of the ammunition through the vents 13 in the tubular body 8 of the primer tube 1.

The combustion gases from the propellant charge 4 cause the propulsion of the projectile 3 as well as the ejection of the tubular body 8, sleeve 19 and disk 20 assembly of the primer tube.

Indeed, the combustion gas pressure from the propellant charge 4 is exerted upon the pressure receiving surface 25 of the disk 20 and it is enough to propel the tubular body and eject it from the weapon barrel.

Thus, the main advantage of the invention lies in that the primer tube does not remain attached to the obstructing base after firing and thus does not hinder its ejection from the weapon chamber and its subsequent storage in the turret.

Preferentially, as has just been described, the disk is positioned at the front end of the tubular body. Said body is thus propelled by the load's propellant gases. Naturally, without departing from the scope of the invention, this disk may be positioned elsewhere, such as for example at the middle part of the tubular body.

The tubular body can also incorporate several disks spaced along the body. This will further improve the guidance of the primer tube but also the rigidity of the combustible case.

A further advantage of the invention lies in being able to load the propellant powder by the case front.

FIG. 3 shows a variant embodiment.

This variant varies from the previous embodiment in that the sleeve 19 of the tubular body 8 fits onto an intermediate tubular part 28.

In this variant, the case 5 incorporates a rim 32 onto which the intermediate part 28 is clipped. For this, the intermediate part 28 incorporates a circular groove intended to receive tabs integral with the rim 32 of the case 5. The intermediate part 28 will, for example, be made of a plastic material such as polyamide.

The case 5 also incorporates at least one opening 31 that is intended to allow the propellant powder to be loaded.

In this variant embodiment, the rear ignition unit 7 is screwed onto the intermediate part 28. It also incorporates a cylindrical seat 30 that abuts against the rim 32.

Here, the disk 20 does not have openings.

A primer tube according to this variant is mounted as follows:

- the intermediate part 28 is clipped onto the rim 32 of the case 5,
- the rear ignition unit 7 is screwed onto the intermediate part 28,
- the tubular body 8 fitted with the disk 20 is placed inside the case 5 (the tubular body naturally having previously been filled with priming composition 14), the sleeve 19 of the tubular body is fitted onto the intermediate part 28, the lower part of the case is loaded with propellant powder via openings 31 in the case 5, the obstructing base 6 is mounted onto the case 5 and the rear unit 7, the base and the rear unit are joined by a nut 29, then the projectile and the upper propellant charge can be introduced inside the case 5, as has already been described previously, that is by means of a casing joining the projectile and its load.

The advantage of this variant lies in the possibility of loading of the propellant powder from the rear of the case, at the base end.

Loading from the rear may therefore avoid the necessity of using a casing such as that described in patent FR2622687. Thus, the projectile may be joined in a conventional manner directly onto the case and the full load of the ammunition can be carried out from the case rear. In this case, the disk 20 must have openings so as to allow the volume delimited by the projectile and the disk to be filled.

Naturally, as for the previous variant, the sleeve 19 can also be temporarily linked to the intermediate part 28, for example by clipping. Such a link would make the propellant powder loading phase safer and would avoid the inadvertent translation of the tubular body 8.

FIG. 4 shows a second embodiment of the invention.

It differs from the first one in that the primer tube 1 receives linear energetic primacords 26.

Said primacords are loaded with the pyrotechnic composition and are well known to the expert. Reference may be made, for example, to patent EP0344098.

These cords are introduced inside the internal channel 15 of the tubular body 8 until reaching the rear ignition unit 7. Naturally, the tubular body has no obstructing wall at its upper end 22 so as to allow the cords 26 to pass.

The cords 26 exit the channel 15 by a flared part 27 and extend over the rear part of the projectile 3. The flared part 27 thus makes the passage of the cords from the primer tube to the tail end of the projectile easier.

So as to make it easier to introduce the cords inside the tubular body, they can be linked at least over part of their length and preferably at their ends, so as to form a strand.

In this embodiment, it is not necessary to provide an inner sheath for the tubular body.

This embodiment applies in particular to ammunition whose projectile is very long and is deeply embedded in the propellant charge.

Thus, the cords arranged along the projectile or against the inner wall of the combustible case allow priming to be ensured at several spots, thereby improving priming performances.

The advantage of this second embodiment lies in that the cords are guided during their passage through the tubular body, thereby making their installation easier.

A further advantage lies in that the cords insensitive to any mechanical stresses to which ammunition may be subjected and thus do not deteriorate. Indeed, they are not connected to the rear ignition unit and are able to slide freely inside the tubular body of the primer tube.

Naturally, this second embodiment may be combined with the variant previously described with reference to FIG. 3, thereby allowing the propellant powder to be loaded from the rear of the case, at the base end.

What is claimed is:

1. A primer tube for ensuring ignition of a propellant charge of artillery ammunition, said primer tube comprising:

a tubular body;

a priming composition located in said tubular body;

a rear ignition unit located in said tubular body;

a sleeve at a rear portion of the tubular body slidably covering the rear ignition unit;

at least one pressure receiving surface for cooperating with said tubular body and for receiving propellant gas pressure generated when a propellant charge is ignited, for propelling the primer tube, wherein the pressure receiving surface comprises a disk integral with an upper end of the tubular body and extending radially outward from the tubular body, and said sleeve is for translating away from said rear ignition unit when propellant gas pressure is applied against said pressure receiving surface.

2. The primer tube according to claim 1, wherein the disk comprises a cylindrical seat having a diameter substantially equal to an internal diameter of a combustible ammunition case.

3. The primer tube according to claim 2, wherein the disk comprises openings permitting loading of a propellant into an ammunition.

4. The primer tube according claim 1, wherein the priming composition is located in an internal channel of the tubular body, said channel delimited at its upper end by a wall integral with the disk and at its lower end by a foil.

5. The primer tube according to claim 4, wherein the priming composition comprises a pulverulent material.

6. The primer tube according to claim 4, wherein the priming composition comprises a stack of tablets.

7. The primer tube according to claim 4, wherein the priming composition has an axial channel therein.

8. The primer tube according claim 1, wherein the priming composition comprises at least two energetic primacords.

9. The primer tube according to claim 8, wherein the tubular body further comprises a flared portion at its upper end, and the primacords are adjacent said flared portion.

10. The primer tube according to claim 1, wherein the disk and tubular body are made of an inert material.

11. A primer tube and cartridge case for ensuring ignition of a propellant charge of artillery ammunition, said primer tube comprising:

a cartridge case containing a propellant charge;

a tubular body located inside the case;

a priming composition located in said tubular body;

a rear ignition unit located in said tubular body;

a sleeve at a rear portion of said tubular body slidably covering the rear ignition unit;

at least one pressure receiving surface for cooperating with said tubular body and for receiving propellant gas pressure generated when a propellant charge is ignited, for propelling the primer tube, wherein the pressure receiving surface comprises a disk integral with an upper end of the tubular body and extending radially outward from the tubular body, and said sleeve is for translating away from said rear ignition unit when propellant gas pressure is applied against said pressure receiving surface.

12. The primer tube and cartridge case according claim 11, wherein the cartridge case comprises a second tubular sleeve located within said tubular sleeve.

13. The primer tube and cartridge case according to claim 12, wherein the second tubular sleeve is attached to the rear ignition unit which is integral with a munition base.

14. The primer tube and cartridge case according to claim 12, wherein the second tubular sleeve further comprises an intermediate part integral with the case and the rear ignition unit.

* * * * *